US006739170B1

(12) United States Patent
Rosier

(10) Patent No.: US 6,739,170 B1
(45) Date of Patent: May 25, 2004

(54) OFFSET NOSE ASSEMBLY WITH IMPROVED DEFLECTOR AND GUARD ASSEMBLIES

(75) Inventor: Hendrik E. Rosier, Port Ewen, NY (US)

(73) Assignee: Huck International, Inc., Tuscon, AZ (US)

( * ) Notice: Subject to any disclaimer, the term of this patent is extended or adjusted under 35 U.S.C. 154(b) by 0 days.

(21) Appl. No.: 10/390,115

(22) Filed: Mar. 17, 2003

(51) Int. Cl.[7] ..... B21J 15/20
(52) U.S. Cl. ..... 72/391.8; 29/243.529
(58) Field of Search ..... 72/391.8, 391.4, 72/391.2, 453.17; 29/243.529, 243.522, 243.521

(56) References Cited

U.S. PATENT DOCUMENTS

| | | | | |
|---|---|---|---|---|
| 3,039,270 A | | 6/1962 | Simmons | 60/54.5 |
| 3,254,522 A | | 6/1966 | Elliott et al. | 72/391 |
| 3,526,441 A | | 8/1970 | Bell et al. | 72/391 |
| 4,118,969 A | | 10/1978 | Corbett | 72/391 |
| 4,515,005 A | | 5/1985 | Klein | 72/391 |
| 4,580,435 A | | 4/1986 | Port et al. | 72/391 |
| 4,597,263 A | | 7/1986 | Corbett | 60/534 |
| 4,615,206 A | | 10/1986 | Rosier | 72/391 |
| 4,796,455 A | | 1/1989 | Rosier | 72/391 |
| 4,813,261 A | | 3/1989 | Rosier | 72/391 |
| 4,878,372 A | | 11/1989 | Port et al. | 72/391 |
| 4,896,522 A | * | 1/1990 | Rosier | 72/391.8 |
| 4,964,292 A | | 10/1990 | Kaelin et al. | 72/453.17 |
| 5,146,773 A | | 9/1992 | Rosier | 72/391.4 |
| 5,208,959 A | | 5/1993 | Rosier et al. | 29/252 |
| 5,371,933 A | | 12/1994 | Godfrey | 29/243.529 |
| 5,485,727 A | | 1/1996 | Godfrey | 60/572 |
| 5,598,619 A | | 2/1997 | Rosier | 29/243.523 |
| 6,014,801 A | | 1/2000 | Wilcox | 29/243.525 |
| 6,662,420 B1 | * | 12/2003 | Rosier | 29/243.529 |

OTHER PUBLICATIONS

Blueprint: Assy. Nose –6 Blind Bolt Jun. 16, 1999, Drawing No. 99–905.
Blueprint: Nose Assembly –06 May 6, 1992, Drawing No. 99–871 1NW.
Blueprint: Nose Assembly –08 LGP Dec. 3, 1987, Drawing No. 99–1702–1.
Blueprint: Nose Assembly –08 LGP Feb. 18, 1987, Drawing No, 99–1702.
Blueprint: Nose Assembly –08 GP May 30, 1995, Drawing No. 99–1705FB.
Blueprint: Nose Assembly –08GP May 25, 1995, Drawing No. 99–1705–1FB.
Blueprint: Nose Assembly –08 GP Jun. 20, 2001, Drawing No. 99–1705–IFB DG.
Blueprint: Nose Assembly –08 GP Jun. 20, 1998, Drawing No. 99–1705FBDG.

(List continued on next page.)

*Primary Examiner*—David B. Jones
(74) *Attorney, Agent, or Firm*—David P. Maivald

(57) ABSTRACT

An offset nose assembly for installing fasteners is provided that generally includes a drawbar, a swage anvil and a collet. The drawbar has three portions with the third portion transitioning from the second portion by a chamfer, the chamfer being of a preselected angle that is adapted to positively engage a chamfer of a preselected angle of a piston of a fastener installation tool. Additionally, a generally L-shaped guard assembly is provided that is disposed on the collet to cover a gap defined between the collet and the swage anvil. Also, a deflector is provided that is attached to a nut that is threadedly engaged with the rearward end of a bore in the collet, the deflector having a section of a uniform constant outside diameter that integrally transitions to a section that has an outside diameter that gradually lessens along its length.

30 Claims, 4 Drawing Sheets

OTHER PUBLICATIONS

Blueprint: Nose Assembly –08 LGP Apr. 23, 1998, Drawing No. 99–1702–1DG.
Blueprint: Nose Assembly –08 LGP Apr. 21, 1998, Drawing No. 99–1702DG.
Blueprint: Nose Assembly –12 LGP Apr. 24, 1998, Drawing No. 99–1754DG.
Blueprint: 208–625 Tool Sep. 23, 1988, Drawing No. 208–625.
Blueprint: KIT, 1700 Straddle Nose Guard Apr. 27, 1998, Drawing No. 125673.

* cited by examiner

OFFSET NOSE ASSEMBLY WITH IMPROVED DEFLECTOR AND GUARD ASSEMBLIES

FIELD OF THE INVENTION

This invention relates to a fastener installation tool and more particularly to a fastener installation tool having an offset nose assembly with an improved deflector and guard assemblies.

BACKGROUND OF THE INVENTION

Fastener installation tools having offset nose assemblies are used to provide access to multi-pieced fasteners located between closely spaced workpieces or within small clearance spaces. Installation tools and related nose assemblies are utilized in conjunction with a hydraulic pressure source for installing multi-pieced fasteners by applying a relative axial pulling force, for example, between a pin or mandrel and a collar or sleeve. A lockbolt or swage type fastener is an example of a multi-piece fastener that has a pin and collar adapted to be set with the relative axial pulling force of an installation tool. A blind type fastener is another example of a multi-piece fastener that has a pin and a sleeve adapted to be set with the relative axial pulling force of an installation tool. With both the lockbolt and blind type fasteners, the pin has an elongated shank provided with a pintail or pull portion having a plurality of pull grooves adapted to be gripped by a plurality of chuck jaws in the nose assembly. In the deactuated condition, the chuck jaws will be normally held open to facilitate insertion of the pintail portion into the aperture defined by the opened chuck jaws as well as ejection after the fastener has been set. During actuation of the tool with the pintail portion located in the nose assembly, the chuck jaws will be moved to a closed condition for engagement with the pull grooves whereby the pull grooves will be gripped by the chuck jaws.

A swage anvil is adapted to engage the collar or sleeve, depending upon the type of fastener, and, upon actuation of the tool and with the chuck jaws gripping the pintail portion of the pin shank, as noted, a relative axial pulling force is then applied between the collar or sleeve and pin of the fastener by way of the relative axial force between the chuck jaws and the swage anvil. Typically, the pin or mandrel is provided with a weakened portion or breakneck groove which is located on the pin shank between the pull or pintail portion and the remainder of the shank and is adapted to fracture at a preselected axial load, i.e. pin break load, after the fastener has been set. This results in an installed fastener having a generally flush structure with minimal or no pintail protrusion. In certain tools, the severed pintail portion is ejected rearwardly out through the back end of the tool. The offset nose assembly of the present invention is a tool that has severed pintails ejected from the rear of the offset nose assembly.

The magnitude of the pin break load required to fracture the breakneck groove, however, can result in the generation of a reaction load of significant magnitude. The magnitude of pin break load can be especially high with swage type fasteners since the breakneck groove must be of sufficient strength to withstand the high installation loads required for the swage anvil to swage the collar onto the pin. As a result, in hand held installation tools employing a construction for pass through or rearward ejection, the severed pintail portion could be ejected with a considerable force in the direction of the operator. As a result, it has been a common practice with such tools to utilize a pintail deflector made of an elastomeric material to absorb some of the force of the pintail portion and to deflect the pintail portion away from the operator.

An offset nose assembly may include, for example, a collet and a swage anvil for swaging a collar into the grooves of a fastener pin. In such designs, the swage cavity and first bore of the collet that is adapted to receive passage of severed pintails are radially offset from the axis of the piston which drives a drawbar against the collet. This arrangement allows the radially offset swage cavity to access the fastener pin and collar without interference from the other portions of the offset nose assembly and the fastener installation tool.

It is desirable for an offset nose assembly to be rotatable about the drawbar axis of the offset nose assembly. Such rotatability provides the offset nose assembly with greater access to fastener pins and collars located between closely spaced workpieces or within small clearance spaces. With rotatable offset nose assemblies, cam-out of the drawbar from the piston must be eliminated to avoid harm to the operator of the tool. In the prior art, a roll pin assembly was used to eliminate cam-out of the drawbar in a rotatable offset nose assembly. A roll pin passed through holes machined through the drawbar and collet that locked the drawbar and collet together. This locked construction eliminated cam-out of the drawbar in the prior art rotatable nose assembly. The roll pin would reciprocate back and forth in a slot machined in the swage anvil during use of the offset nose assembly. An example of this prior art assembly is shown in FIG. 5 of U.S. Pat. No. 4,796,455 to Rosier.

The present invention departs from the design of U.S. Pat. No. 4,796,455 by completely eliminating the roll pin approach. In the present invention, the drawbar of the offset nose assembly and the piston of the fastener installation tool are provided with chamfers that are complementary angles of one another that are positively engaged when the drawbar is threaded into the piston of the installation tool. The positive engagement between the drawbar and the piston eliminates cam-out of the drawbar from the piston. Such a design in an offset nose assembly eliminates the need of using the roll pin approach of U.S. Pat. No. 4,796,455. As can be appreciated, the present invention has efficiencies in the manufacture of the offset nose assembly with comparison to U.S. Pat. No. 4,796,455. In the present invention, the use of a roll pin is eliminated, holes do not need to be machined through the drawbar and collet to receive the roll pin and a slot does not need to be machined through the swage anvil. The design of the present invention has efficiencies in its manufacture over the prior art.

It is desirable to equip an offset nose assembly with a pintail deflector that deflects pintails that are severed from fastener pins during the process of swaging a collar into the grooves of a fastener pin. In the prior art, deflectors were often secured to the rear portion of the first bore of the collet with a retaining nut or screw that projected outwardly from the rear portion of the first bore. Additionally, the deflectors were relatively lengthy pieces of elastomeric material that also reduced the effective diameter of the passageway that ejected the severed pintail. With actuation of the tool, the collet would be driven rearwardly causing the retaining nut or screw and deflector to back into a workpiece. Backing into workpieces has the potential of causing damage to soft workpieces made of fragile composite materials. Damage to workpieces must always be minimized. An example of a prior art deflector can be seen in FIG. 1 of U.S. Pat. No. 4,615,206 to Rosier with reference to element 176. Furthermore, the reduction in size of the passageway for ejection of the pintail can lead to pintails being jammed within the passageway which must be removed from the tool in a time consuming process.

The present invention departs from the use of a projecting retaining nut or other such projecting affixation devices for securing relatively lengthy deflectors to the rear portion of the first bore of the collet. An acorn shaped deflector or frusto-conical shaped deflector that has a plurality of tapering beams adapted to deflect a severed pintail from a fastener is used. The deflector is made from a suitable elastomeric material and is thermally adhered or glued to a threaded nut which is threadedly engaged with the rear portion of the collet. The deflector is collapsible and the threaded nut is seated flush with the rear portion of the first bore of the collet. With actuation of the tool, the collet would be driven rearwardly causing the deflector to back into a workpiece which would collapse the deflector and the threaded nut would not engage the workpiece because it is seated flush. No damage can occur to the workpiece with the deflector of the present invention. Additionally, the manner in which the deflector is secured to the collet does not reduce the diameter of the passageway that ejects pintails so the risk of pintails lodging in the passageway is minimized as well.

It is desirable to equip an offset nose assembly with guard assemblies to minimize the pinch points in the offset nose assembly to avoid personal injury to the operator. Prior art guard assemblies are typically attached to the offset nose assembly with screws. Attaching the guard assemblies with screws is a time consuming process and the guard assemblies are easily removed to circumvent the safety features of the offset nose assembly. An example of a prior art deflector can be seen in FIG. 5 of U.S. Pat. No. 4,615,206 to Rosier with reference to element 175.

The present invention departs from the use of guard assemblies that are secured to the nose assembly with a screw. The guard assemblies of the present invention are provided with projections that are adapted to be received in dimples of the swage anvil and the collet. The guard assemblies are not easily removed from the offset nose assembly and are completely contained within the nose assembly envelope which adds to the safety of the present invention.

SUMMARY OF THE INVENTION

It is an object of the invention to minimize cam-out of a drawbar of an offset nose assembly from a piston of a fastener installation tool.

It is another object of the invention to provide a compact, fully collapsible deflector that minimizes damage to workpieces during operation of a fastener installation tool.

It is an additional object of the invention to provide guard assemblies that may be snapped onto an offset nose assembly to eliminate all pinch points on the nose assembly.

One object of the invention is achieved by providing an offset nose assembly that generally consists of a drawbar, a swage anvil and a collet. The drawbar has a first diameter portion, a second diameter portion, a third diameter portion and threads disposed at the rearward end of the drawbar. The first diameter portion has an enlarged bearing head and a diameter greater than the second diameter portion. The second diameter portion has a diameter greater than the third diameter portion and transitions from the first diameter portion by a shoulder. The third diameter portion transitions from the second diameter portion by a chamfer. The chamfer is of a preselected angle that is adapted to positively engage a chamfer of a preselected angle of a piston of a fastener installation tool. The swage anvil has a swage cavity and has a first aperture adapted to receive a portion of the first diameter portion of the drawbar. The collet has a first bore and a second bore. The first bore is adapted to receive a chuck jaw assembly for grippingly engaging fasteners. The second bore is adapted to receive the second diameter portion of the drawbar. The collet is slidably disposed within the swage anvil. In the offset nose assembly, the drawbar has a portion of the first diameter portion slidably disposed within the first aperture, the second diameter portion of the drawbar is slidably disposed within the second bore of the collet and the third diameter portion of the drawbar passes through the second aperture of the swage anvil.

Another object of the invention is achieved by providing an offset nose assembly with a deflector. The deflector is attached to a nut that is threadedly engaged with the rearward end of the first bore of the collet. The deflector has a section of a uniform constant outside diameter that integrally transitions to a section that has an outside diameter that gradually lessens along its length. The portion of gradually lessened outside diameter has a plurality of rearwardly extending tapering beams that are collapsible.

An additional object of the invention is achieved by providing the collet of an offset nose assembly with a generally L-shaped guard assembly. The guard assembly is adapted to cover a gap defined between the collet and the swage anvil. The collet has dimples on either side of the exterior surface of the collet and the guard assembly has opposing projections that are disposed in the dimples.

DETAILED DESCRIPTION OF PREFERRED EMBODIMENTS

Figure 1:
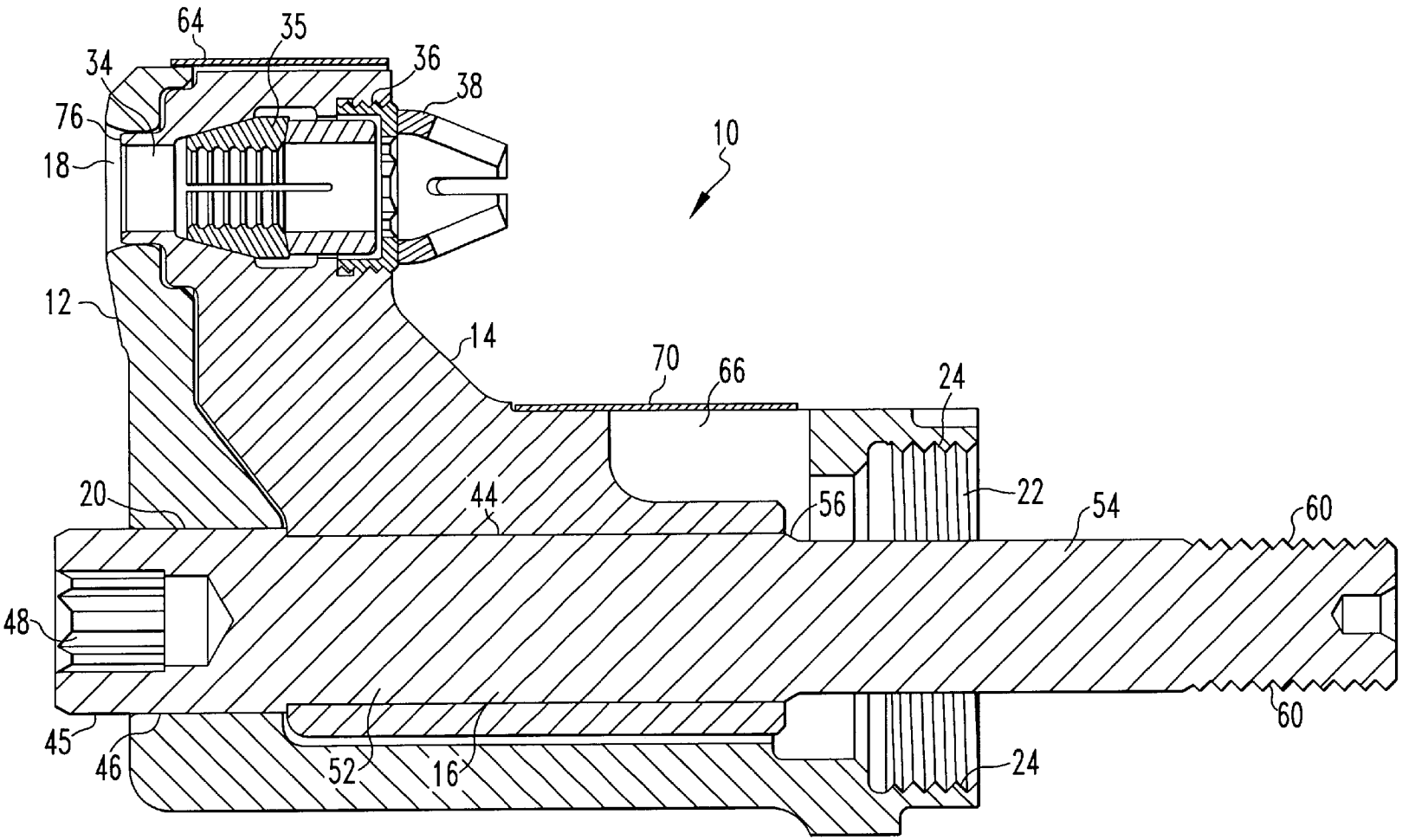
FIG. 1 is a side sectional view of the offset nose assembly with a deflector and guard assemblies attached to the offset nose assembly.
Figure 2:
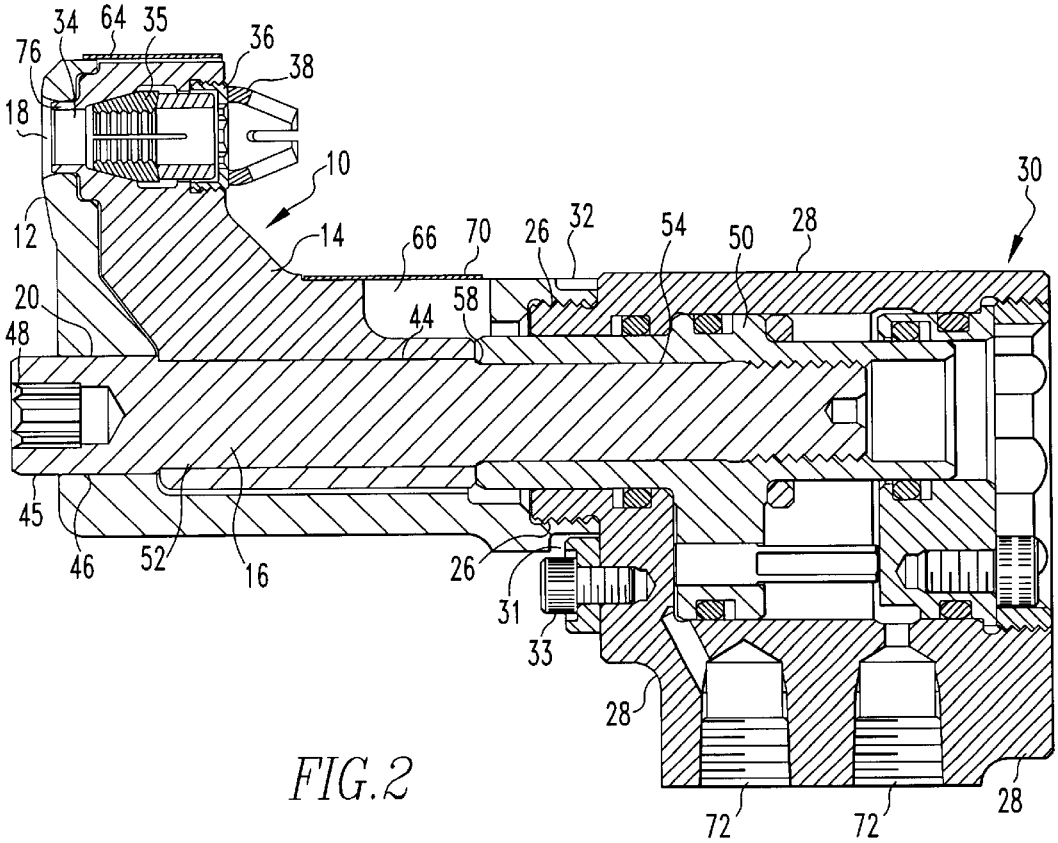
FIG. 2 is a side sectional view of the offset nose assembly with a deflector and guard assemblies attached to the offset nose assembly with the drawbar threadedly attached to the piston and the chamfers of the drawbar and the piston being positively engaged.

With reference to FIG. 1, an offset nose assembly 10 is displayed that generally includes a swage anvil 12, a collet 14 and a drawbar 16. The swage anvil 12 generally includes a swage cavity 18, a first aperture 20 and a second aperture 22. The swage cavity 18 is adapted to swage a collar into the grooves of a fastener pin upon actuation of the offset nose assembly 10. A portion of the second aperture 22 has threads 24 (see FIG. 1) for threaded engagement 26 with a housing 28 of a fastener installation tool 30. (see FIG. 2) As can be seen in FIG. 2, the swage anvil 12 has a bottom groove 31 that permits rotatable movement of the offset nose assembly 10 relative to the axis of the drawbar 16. Upper groove 32 acts as a stop when the offset nose assembly 10 is attached in an upside down orientation (not shown) to the fastener installation tool 30. A screw 33 is threadedly engaged with the housing 28 of the fastener installation tool 30. Screw 33 is either disposed within groove 31 or 32 during operation of the fastener installation tool 30. Screw 33 acts as a stop for rotation of the offset nose assembly 10 relative to the axis of the drawbar 16. Groove 31 permits 120 degrees of rotatable movement of the offset nose assembly 10 relative to the axis of the drawbar 16 whereas groove 32 does not permit rotation of the offset nose assembly 10 relative to the axis of the drawbar 16.

Figure 3:
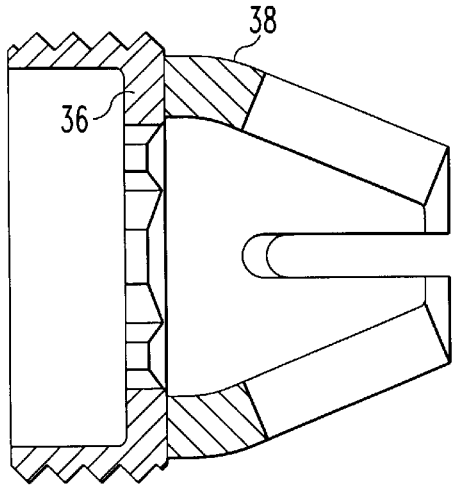
FIG. 3 is a side sectional view of the deflector.

With reference to FIG. 1, the collet 14 has a first bore 34 that is adapted to receive a unitized chuck jaw assembly 35 that is adapted to grasp the pintail portion of a fastener. The rearward end of the first bore 34 has female threads that are adapted to receive male threads of a nut 36 that has a deflector 38 thermally adhered or glued to the rear end of the nut 36. (see FIG. 3). The deflector 38 is generally acorn shaped or frustoconical in construction.

Figure 4:
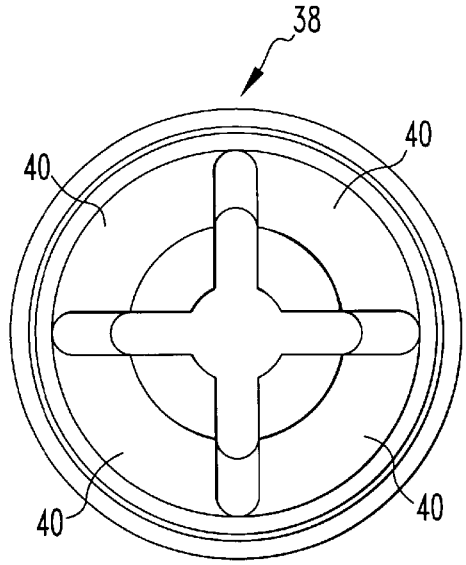
FIG. 4 is a rear view of the deflector.

With reference to FIG. 4, the deflector 38 has a section of a uniformly constant outside diameter that integrally transitions to a section that has an outside diameter that is gradually reduced along its entire length wherein a portion of that length consists of a plurality of rearwardly extending tapered beams 40 that are generally equal in size to one another. While FIG. 4 shows the deflector with four tapered beams 40, the deflector 38 could be provided with any number of beams 40 as well. The deflector 38 is made of a suitable elastomeric material and is collapsible to avoid damaging a workpiece during actuation of the tool. Also, the tapered beams 40 at the rearward end of the deflector 38 will engage severed pintails as they are ejected, and avoid contact with the operator of the installation tool 30.

With the deflector 38 attached to the nut 36, the nut 36 is threadedly engaged with the threads at the rearward end of the first bore 34. The nut 36 is seated flush with the outer surface of the rearward end of the first bore 34. Such an assembly eliminates the possibility of the nut 36 engaging and damaging a workpiece during actuation of the tool. Damage to a workpiece is of particular concern when the workpiece is made of relatively soft composite materials that are used in aerospace applications.

With reference to FIG. 1, the collet 14 has a second bore 44 that is adapted to receive a portion of the drawbar 16. The drawbar 16 generally has a first diameter portion 45 that has an enlarged bearing head 46 that has a hex slot 48 that is adapted to receive a hex key to assist in threadedly engaging the drawbar 16 to a piston 50 of the installation tool 30. (see FIG. 2) With reference to FIG. 1, the head 48 is adapted to have a slight clearance fit in the first aperture 20. The head 48 portion of the drawbar 16 transitions with a shoulder to a second diameter portion 52 of the drawbar that is adapted to be slidably disposed within the second bore 44. The second diameter portion 52 of the drawbar 16 has a reduced diameter than the first diameter portion 45. The second diameter portion 52 transitions to a third diameter portion 54 with a chamfer 56 of around 30 degrees. The chamfer 56 is of an angle that positively engages with a complementary angle of a chamfer 58 of the piston 50. The chamfers 56 and 58 positively engage one another as shown in FIG. 2 when the drawbar 16 is threadedly engaged with the piston 50 to prevent the drawbar 16 from camming out of the piston 50 during operation of the fastener installation tool 30. Cam-out of the drawbar 16 must be controlled in an offset nose assembly 10 to prevent personal injury to the operator of the fastener installation tool 30. While the angle of chamfer 56 is around 30 degrees, one of skill in the art would realize that chamfer 56 could have an angle anywhere within the range of 5 degrees to 85 degrees so long as the chamfer 58 is supplied with a complementary angle that mates with chamfer 56 for positive engagement between chamfers 56 and 58. The rearward end of the drawbar 16 is provided with male threads 60 in order for the drawbar 16 to be threadedly engaged with female threads of the piston 50 as shown in FIG. 2. Additionally, it should be noted that the first diameter portion 45 or large bearing head 46 is of a diameter larger than the second bore 44 to provide engagement of the shoulder of the head 46 with the exterior surface adjacent to the second bore 44 of the collet 14.

Figure 5:
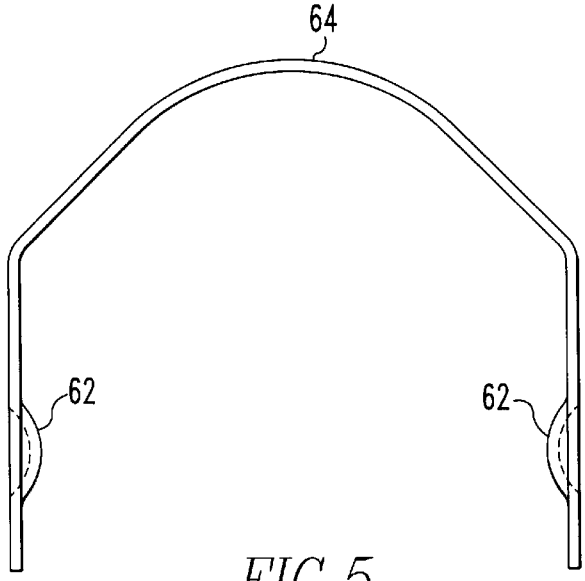
FIG. 5 is a rear view of the top guard assembly.
Figure 6:
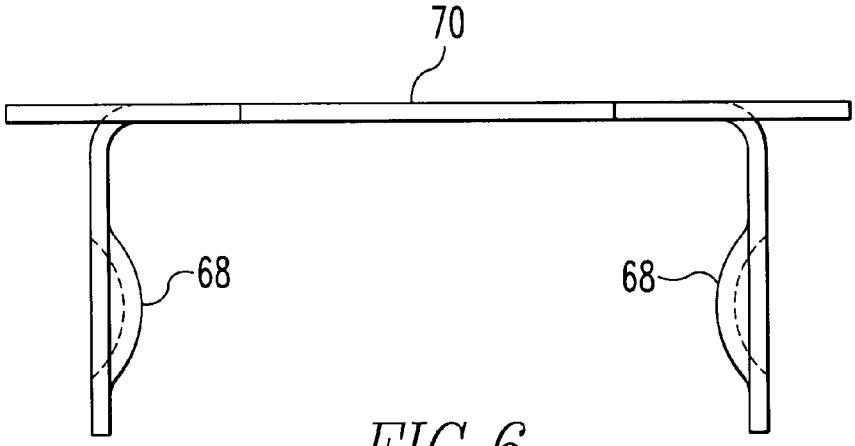
FIG. 6 is a rear view of the bottom guard assembly.

On the exterior surface of the swage anvil 12 close to the swage cavity 18 is disposed two pairs of opposing dimples (not shown) on either side of the exterior surface of the swage anvil 12. The dimples are adapted to receive a plurality of projections 62 that are disposed on a generally U-shaped guard assembly 64. The U-shape of the guard assembly 64 can most readily be seen with reference to the FIG. 5 rear view of the guard assembly 64. Various views of the guard assembly are provided in FIGS. 1, 2 and 5. The guard assembly 64 is attached to the offset nose assembly 10 by disposing the projections 62 into the dimples (not shown) of the swage anvil 12. Securing the guard assembly 64 to the swage anvil 12 is faster than the prior art method of securing a guard assembly to the swage anvil 12 with screws. The guard assembly 64 is an important safety feature that eliminates pinch points between the swage anvil 12 and collet 14 during actuation of the offset nose assembly 10.

Figure 7:
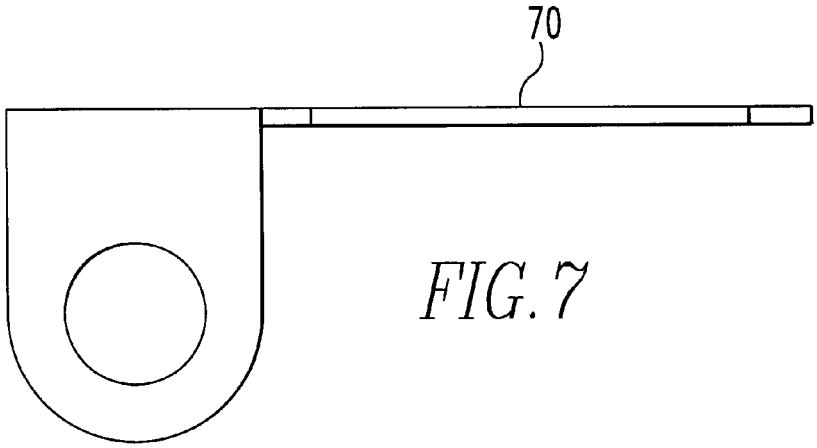
FIG. 7 is a side view of the bottom guard assembly.

On the exterior surface of the collet 14 close to a gap 66 defined between the swage anvil 12 and collet 14 is disposed one pair of opposing dimples (not shown) on either side of the exterior surface of the collet 14. The dimples are adapted to receive a plurality of projections 68 that are disposed on a generally L-shaped guard assembly 70. The L-shape of the guard assembly 70 can most readily be seen with reference to the FIG. 7 side view of the guard assembly 70. Various views of the guard assembly 70 are provided in FIGS. 1, 2, 6 and 7. The guard assembly 70 is attached to the offset nose assembly 10 by disposing the projections 68 into the dimples (not shown) of the collet 14. Securing the guard assembly 70 to the collet 14 is faster than the prior art method of securing a guard assembly around the swage anvil 12 and collet 14 with screws. See, for example, the prior art guard shown in the 1700 Straddle Nose Drawing dated Apr. 27, 1998. The guard assembly 70 also does not take up the critical space of the envelope above the collet 14. Minimizing the obstructions in the area of this envelope is critical in aerospace applications. The guard assembly 70 is also an important safety feature that eliminates pinch points in the gap 66 defined between the swage anvil 12 and collet 14 during actuation of the offset nose assembly 10. The guard assemblies 64 and 70 are of sufficient length and strength to avoid having an operator expose their fingers to the pinch points between the swage anvil 12 and collet 14 during use of the fastener installation tool 30.

The remaining components of the fastener installation tool 30 are well known in the art so the description of these elements has been omitted for the purpose of simplicity. While the offset nose assembly 10 and fastener installation tool 30, as shown and described, is specifically configured for the installation of lockbolt or swage type fasteners, features of the present invention can be utilized for tools for installing blind fasteners and other non-swage type fasteners which are installed by the application of a relative axial pulling force. Details of such fasteners have been omitted for purposes of simplicity it being understood that references to pins, collars and portions thereof are of the type well known in the fastener art.

One method of securing together the various components of the offset nose assembly 10 is as follows. The unitized chuck jaw assembly 35 is disposed within the first bore 34 of the collet 14. The nut 36 with the deflector 38 already attached to the nut 36 is threadedly engaged with the threads at the rearward portion of the first bore 34 so the nut 36 is seated flush with the exterior surface of the collet 14. Next, the projections 68 of the L-shaped guard assembly 70 are disposed within the dimples (not shown) of the collet 14 that are close to the gap 66 between the swage anvil 12 and collet 14. The collet 14 is slidably disposed within the swage anvil 12. The projections 62 of the U-shaped guard assembly are disposed within the dimples (not shown) of the swage anvil 12 that are close to the swage cavity 18. The drawbar 16 passes through the first aperture 20, the second bore 44 and the second aperture 22 with the shoulder of the large bearing head 46 engaging the exterior surface of the collet 14 close to the second bore 44. The first diameter portion 45 of the drawbar 16 is slidably disposed within the first aperture 20 and the second diameter portion 52 of the drawbar 16 is slidably disposed within the second bore 44. This assembly of components is then attached to the fastener installation tool 30 by threadedly engaging 26 the swage anvil 12 to the housing 28 as shown in FIG. 2. The drawbar 16 is threadedly engaged with the piston 50 as shown in FIG. 2 as well. Finally, screw 33 is secured to the housing 28 within bore 31 for use of the fastener installation tool 30 as shown in FIG. 2 or within bore 32 for use of the offset nose assembly 10 in an upside down orientation (not shown) relative to the fastener installation tool 30.

A separate hydraulic pressure source (not shown) is connected to ports 72 by suitable hydraulic hoses (not shown). A control unit (not shown) that includes a switch (not shown) is also provided that is connected to the hydraulic pressure source (not shown) via the hydraulic hoses (not shown) that is operable from a supply of electric current through suitable conductors to actuate the supply and removal of hydraulic fluid to the fastener installation tool 30. In an alternate embodiment, the control unit (not shown) may be operable from a source of pneumatic energy to actuate the supply and removal of hydraulic fluid to the fastener installation tool 30. It is noted that the details of these particular components have been omitted from the FIGS. because the components are well known in the art and have been omitted for the purpose of simplifying the FIGS. and describing the claimed invention.

In the deactuated condition of fastener installation tool 30, the chuck jaws of the chuck jaw assembly 35 are radially separated and in an opened condition. In this condition, the shank of a pin of a swage type fastener can be inserted through the swage cavity 18 and into the opening defined by the radially separated chuck jaws.

When the operator depresses a switch (not shown), the piston 50 along with the drawbar 16 are actuated rearwardly in the pull stroke of the fastener installation tool 30. In the pull stroke, the collet 14 is moved rearwardly as well. As this occurs, the chuck jaws are moved radially inwardly. Chuck jaws are moved to their radially closed position in which the chuck jaw teeth now fully grip the similarly shaped grooves on the pull portion of the pin shank of the fastener. At this time, the swage cavity 18 is engaged with the fastener collar which is located over the shank of the pin. Further movement of the collet 14 and chuck jaw assembly 35 relative to the swage cavity 18 will result in application of the desired relative axial force whereby the collar will be swaged onto lock grooves on the shank of the pin. Upon the application of additional relative axial force, the pin member will be severed at the breakneck groove. Upon fracture of the pin shank, the resultant shock load will move the chuck jaws axially rearwardly and, at the same time, will resiliently move the chuck jaws to their open condition whereby the severed portion of the pin shank will be released by the chuck jaws. The severed portion of the pin member will then pass through the installation tool 30 via the first bore 34 for ejection out at the rearward end. The ejection of the severed portion of the pin member is safely controlled by engaging the deflector 38.

Next, the fastener installation tool 30 is returned to its original, deactuated condition by the operator releasing the actuating switch. Now, the piston 50 along with the drawbar 16 on its return stroke is moved axially forwardly to its original, axially forward position. As this occurs, a collar ejector member 76 that is engaging the swaged collar ejects the collar from the swage cavity 18 due to the axially forward movement of the collet 14 in the return stroke of the fastener installation tool 30.

Having described the presently preferred embodiments of the invention, it is to be understood that the invention may be otherwise embodied within various functional equivalents within the scope of the appended claims.

What is claimed is:

1. An offset nose assembly for installing fasteners comprising:

a drawbar having a first diameter portion, a second diameter portion, a third diameter portion and threads disposed at a rearward end of the drawbar, the first diameter portion having an enlarged bearing head and a diameter greater than the second diameter portion, the second diameter portion having a diameter greater than the third diameter portion and transitioning from the first diameter portion by a shoulder, the third diameter portion transitioning from the second diameter portion by a chamfer, the chamfer being of a preselected angle that is adapted to positively engage a chamfer of a preselected angle of a piston of a fastener installation tool;

a swage anvil having a swage cavity, a first aperture and a second aperture, the first aperture being adapted to receive a portion of the first diameter portion of the drawbar;

a collet having a first bore and a second bore, the first bore being adapted to receive a chuck jaw assembly for grippingly engaging fasteners, the second bore being adapted to receive the second diameter portion of the drawbar, the collet being slidably disposed within the swage anvil; and the drawbar having a portion of the first diameter portion slidably disposed within the first aperture, the second diameter portion slidably disposed within the second bore of the collet and the third diameter portion passing through the second aperture of the swage anvil.

2. The offset nose assembly of claim 1 further comprising threads disposed at the rearward end of the second aperture and a fastener installation tool threadedly engaged with the threads of the second aperture and a piston slidably disposed in the fastener installation tool, the piston having a bore and a chamfer at a forward end of the piston, the bore having threads that threadedly engage the threads of the drawbar, and the chamfer being of a preselected angle that positively engages the chamfer of the drawbar.

3. The offset nose assembly of claim 2 wherein the offset nose assembly is rotatable about the axis of the drawbar.

4. The offset nose assembly of claim 2 wherein the offset nose assembly is secured to the fastener installation tool in an upside down orientation relative to the fastener installation tool.

5. The offset nose assembly of claim 1 further comprising threads disposed at a rearward end of the first bore and a deflector attached to a nut that is threadedly engaged with the rearward end of the first bore, the deflector having a section of a uniform constant outside diameter that integrally transitions to a section that has an outside diameter that gradually lessens along its length, the portion of gradually lessened outside diameter having a plurality of rearwardly extending tapering beams.

6. The offset nose assembly of claim 5 wherein the tapered beams of the deflector are generally equal in size.

7. The offset nose assembly of claim 5 wherein the nut is seated flush with the rearward end of the first bore.

8. The offset nose assembly of claim 5 wherein the deflector is of a preselected shape selected from the group consisting of an acorn and a frusto-conical geometry.

9. The offset nose assembly of claim 1 further comprising a generally L-shaped guard assembly disposed on the collet that is adapted to cover a gap defined between the collet and the swage anvil.

10. The offset nose assembly of claim 9 wherein the collet has dimples on either side of the exterior surface of the collet and the guard assembly has opposing projections that are disposed in the dimples.

11. An offset nose assembly for installing fasteners comprising:

a drawbar having a first portion, a second portion, and a third portion;

a swage anvil having a swage cavity, a first aperture and a second aperture, the first aperture being adapted to receive a portion of the drawbar;

a collet having a first bore and a second bore, the first bore being adapted to receive a chuck jaw assembly for grippingly engaging fasteners and having threads disposed at a rearward end of the first bore, the second bore being adapted to receive the second portion of the drawbar, the collet being slidably disposed within the swage anvil; and the first portion of the drawbar slidably disposed within the first aperture, the second portion of the drawbar slidably disposed within the second bore of the collet and the third portion of the drawbar passing through the second aperture of the swage anvil; and a deflector attached to a nut that is threadedly engaged with the rearward end of the first bore, the deflector having a section of a uniform constant outside diameter that integrally transitions to a section that has an outside diameter that gradually lessens along its length, the portion of gradually lessened outside diameter having a plurality of rearwardly extending tapering beams.

12. The offset nose assembly of claim 11 wherein the tapered beams of the deflector are generally equal in size.

13. The offset nose assembly of claim 11 wherein the nut is seated flush with the rearward end of the first bore.

14. The offset nose assembly of claim 11 wherein the deflector is of a preselected shape selected from the group consisting of an acorn and a frusto-conical geometery.

15. The offset nose assembly of claim 11 further comprising a generally L-shaped guard assembly disposed on the collect that is adapted to cover a gap defined between the collect and the swage anvil.

16. The offset nose assembly of claim 15 wherein the collet has dimples on either side of the exterior surface of the collet and the guard assembly has opposing projections that are disposed in the dimples.

17. The offset nose assembly of claim 11 wherein the third portion transitions from the second portion by a chamfer, the chamfer being of a preselected angle that is adapted to positively engage a chamfer of a preselected angle of a piston of a fastener installation tool, the drawbar having threads disposed at a rearward end of the drawbar.

18. The offset nose assembly of claim 17 further comprising threads disposed at the rearward end of the second aperture and a fastener installation tool threadedly engaged with the threads of the second aperture and a piston slidably disposed in the fastener installation tool, the piston having a bore and a chamfer at a forward end of the piston, the bore having threads that threadedly engage the threads of the drawbar, and the chamfer being of a preselected angle that positively engages the chamfer of the drawbar.

19. The offset nose assembly of claim 18 wherein the offset nose assembly is rotatable about the axis of the drawbar.

20. The offset nose assembly of claim 18 wherein the offset nose assembly is secured to the fastener installation tool in an upside down orientation relative to the fastener installation tool.

21. An offset nose assembly for installing fasteners comprising:

a drawbar having a first portion, a second portion, and a third portion;

a swage anvil having a swage cavity, a first aperture and a second aperture, the first aperture being adapted to receive a portion of the drawbar;

a collet having a first bore and a second bore, the first bore being adapted to receive a chuck jaw assembly for grippingly engaging fasteners, the second bore being adapted to receive the second portion of the drawbar, the collet being slidably disposed within the swage anvil;

the first portion of the drawbar slidably disposed within the first aperture, the second portion of the drawbar slidably disposed within the second bore of the collet and the third portion of the drawbar passing through the second aperture of the swage anvil; and a generally L-shaped guard assembly disposed on the collet that is adapted to cover a gap defined between the collet and the swage anvil.

22. The offset nose assembly of claim 21 wherein the collet has dimples on either side of the exterior surface of the collet and the guard assembly has opposing projections that are disposed in the dimples.

23. The offset nose assembly of claim 21 further comprising threads disposed at the rearward end of the first bore and a deflector attached to a nut that is threadedly engaged with a rearward end of the first bore, the deflector having a section of a uniform constant outside diameter that integrally transitions to a section that has an outside diameter that gradually lessens along its length, the portion of gradually lessened outside diameter having a plurality of rearwardly extending tapering beams.

24. The offset nose assembly of claim 23 wherein the tapered beams of the deflector are generally equal in size.

25. The offset nose assembly of claim 23 wherein the nut is seated flush with the rearward end of the first bore.

26. The offset nose assembly of claim 23 wherein the deflector is of a preselected shape selected from the group consisting of an acorn and a frusto-conical geometry.

27. The offset nose assembly of claim 21 wherein the third portion transitions from the second portion by a chamfer, the chamfer being of a preselected angle that is adapted to positively engage a chamfer of a preselected angle of a piston of a fastener installation tool, the drawbar having threads disposed at a rearward end of the drawbar.

28. The offset nose assembly of claim 27 further comprising threads disposed at the rearward end of the second aperture and a fastener installation tool threadedly engaged with the threads of the second aperture and a piston slidably disposed in the fastener installation tool, the piston having a bore and a chamfer at a forward end of the piston, the bore having threads that threadedly engage the threads of the drawbar, and the chamfer being of a preselected angle that positively engages the chamfer of the drawbar.

29. The offset nose assembly of claim 28 wherein the offset nose assembly is rotatable about the axis of the drawbar.

30. The offset nose assembly of claim 28 wherein the offset nose assembly is secured to the fastener installation tool in an upside down orientation relative to the fastener installation tool.

* * * * *

UNITED STATES PATENT AND TRADEMARK OFFICE

CERTIFICATE OF CORRECTION

PATENT NO. : 6,739,170 B1
DATED : May 25, 2004
INVENTOR(S) : Hendrik E. Rosier

It is certified that error appears in the above-identified patent and that said Letters Patent is hereby corrected as shown below:

Column 9,
Lines 62 and 63, delete “collect” and substitute therefor -- collet --.

Signed and Sealed this

First Day of February, 2005

JON W. DUDAS
*Director of the United States Patent and Trademark Office*